US005158360A

United States Patent [19]

Banke

[11] Patent Number: 5,158,360

[45] Date of Patent: Oct. 27, 1992

[54] HALO CABLE SYSTEM

[76] Inventor: Bryan K. Banke, 3408 Berwyck Rd., Las Vegas, Nev. 89121

[21] Appl. No.: 760,705

[22] Filed: Sep. 16, 1991

[51] Int. Cl.[5] ..... F21V 21/00

[52] U.S. Cl. ..... 362/391; 439/425; 439/531

[58] Field of Search ..... 362/226, 147, 430, 391, 362/396, 404, 407, 416, 417, 418, 806, 811; 439/409, 425, 531

[56] References Cited

U.S. PATENT DOCUMENTS

| | | | |
|---|---|---|---|
| 3,231,731 | 1/1966 | McDonald | 362/226 |
| 4,837,667 | 6/1989 | Grau | 362/407 |
| 4,841,420 | 6/1989 | Baggio et al. | 362/391 |
| 5,025,357 | 6/1991 | Maurer | 362/391 |
| 5,049,081 | 9/1991 | Ribitsch et al. | 362/407 |

FOREIGN PATENT DOCUMENTS

| | | | |
|---|---|---|---|
| 2136638 | 9/1984 | United Kingdom | 439/409 |

*Primary Examiner*—Richard R. Cole
*Attorney, Agent, or Firm*—S. Michael Bender

[57] ABSTRACT

A lighting system uses stretched insulated cables for power with such cables also operating as the supports for a plurality of lamps. The insulated cables are tightly strung in parallel across the ceiling of a room and are provided with twelve volts of D.C. power. One cable is positive and the other is negative, and a pair of cable clamps are then attached to each of the cables with the cable clamps supporting a direct current lamp assembly. A plurality of lamps can be strung in parallel to the cables and adjustable positioning is available through use of the quick release cable clamps.

3 Claims, 6 Drawing Sheets

HALO CABLE SYSTEM

BACKGROUND OF THE INVENTION

1. Field of the Invention

The present invention relates to electric lighting systems, and more particularly pertains to a direct current lighting system utilizable in a dwelling.

2. Description of the Prior Art

The present invention is a variation upon a European lighting system which uses open cables for power and metal rods to conduct the power to a halogen lamp. The non-insulated cables are strung tightly across the ceiling of a room in parallel and are electrified with twelve volts of D.C. power. One cable is positive and the other is negative. Metal rods are draped over these cables, making contact and transferring the power to the halogen lamp.

Because the system is twelve volts D.C. and connected to an insulated, fuse connected invertor, the chances of electric shock are eliminated. The power flowing through the cables is much like that of a toy train set wherein one track is positive and the other is negative.

To produce such a system in the United States would require the cables and metal rods to be insulated to U.S. standards. Even though non-insulated systems are in operation all over Europe in homes and offices, U.S. standards do not allow such systems to be sold commercially.

As such, there appears to be a need for such a system in the United States provided that each of the various components could be designed to satisfy U.S. standards while providing an aesthetic appearance close to that of its European counterpart. In this respect, the present invention substantially fulfills this need.

SUMMARY OF THE INVENTION

In view of the foregoing disadvantages inherent in the known types of D.C. current lighting systems now present in the prior art, the present invention provides an improved D.C. lighting system construction wherein the same has been designed to meet U.S. standards so as to become commercially available in the United States. As such, the general purpose of the present invention, which will be described subsequently in greater detail, is to provide a new and improved D.C. powered lighting system which has all the advantages of the prior art D.C. lighting systems and none of the disadvantages.

To attain this, the present invention essentially comprises a lighting system which uses stretched insulated cables for power with such cables also operating as the supports for a plurality of lamps. The insulated cables are tightly strung in parallel across the ceiling of a room and are provided with twelve volts of D.C. power. One cable is positive and the other is negative, and a pair of cable clamps are then attached to each of the cables with the cable clamps supporting a direct current lamp assembly. A plurality of lamps can be strung in parallel to the cables and adjustable positioning is available through use of the quick release cable clamps.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved D.C. powered lighting system which has all the advantages of the prior art D.C. powered lighting systems and none of the disadvantages.

It is another object of the present invention to provide a new and improved D.C. powered lighting system which may be easily and efficiently manufactured and marketed.

It is a further object of the present invention to provide a new and improved D.C. powered lighting system which is of a durable and reliable construction.

An even further object of the present invention is to provide a new and improved D.C. powered lighting system which is susceptible of a low cost of manufacture with regard to both materials and labor, and which accordingly is then susceptible of low prices of sale to the consuming public, thereby making such D.C. powered lighting systems economically available to the buying public.

Still yet another object of the present invention is to provide a new and improved D.C. powered lighting system which provides in the apparatuses and methods of the prior art some of the advantages thereof, while simultaneously overcoming some of the disadvantages normally associated therewith.

Still another object of the present invention is to provide a new and improved D.C. powered lighting system which is designed to conform to United States standards so as to facilitate a commercial availability in the United States.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
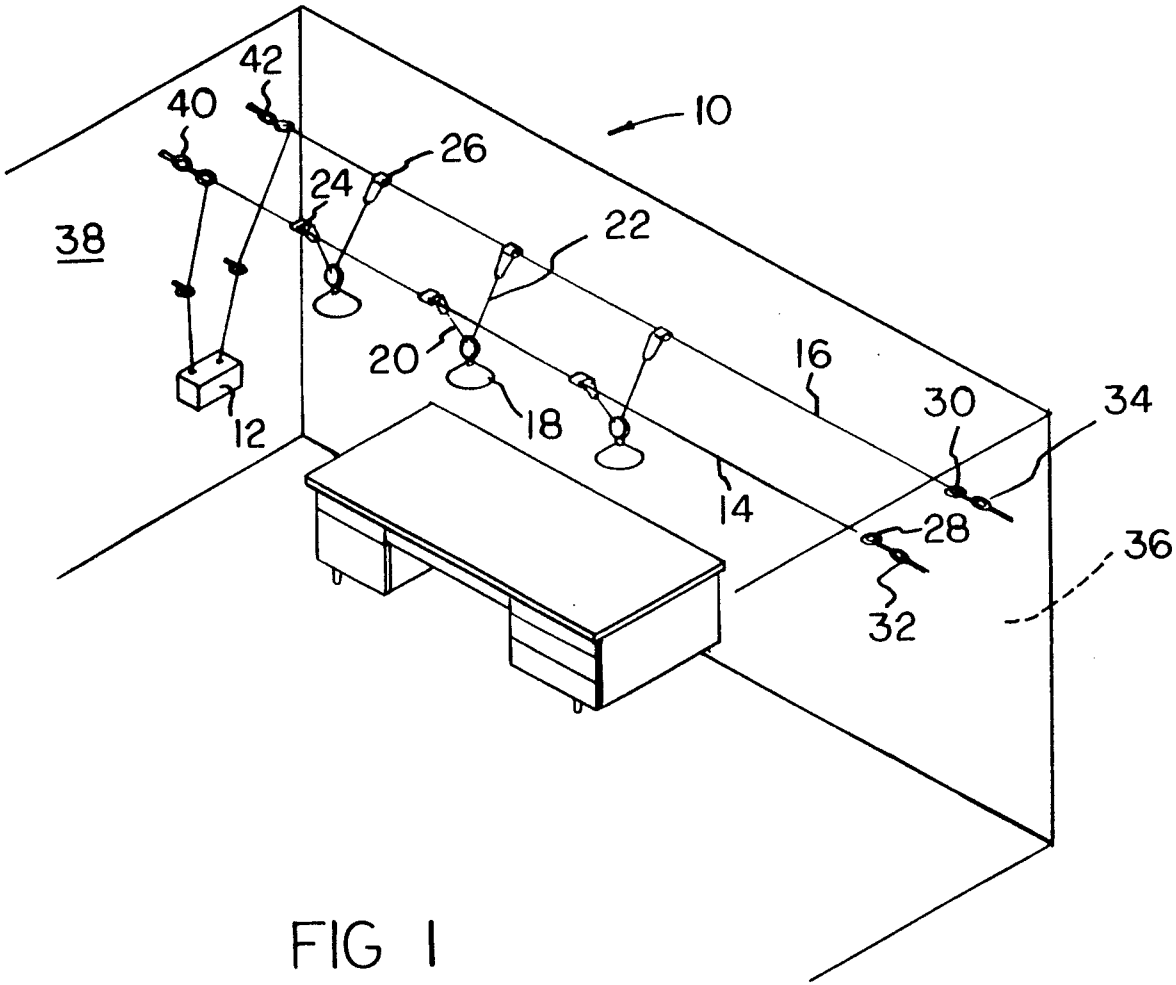
FIG. 1 is perspective view of the lighting system embodying the principles and concepts of the present invention.
Figure 2:
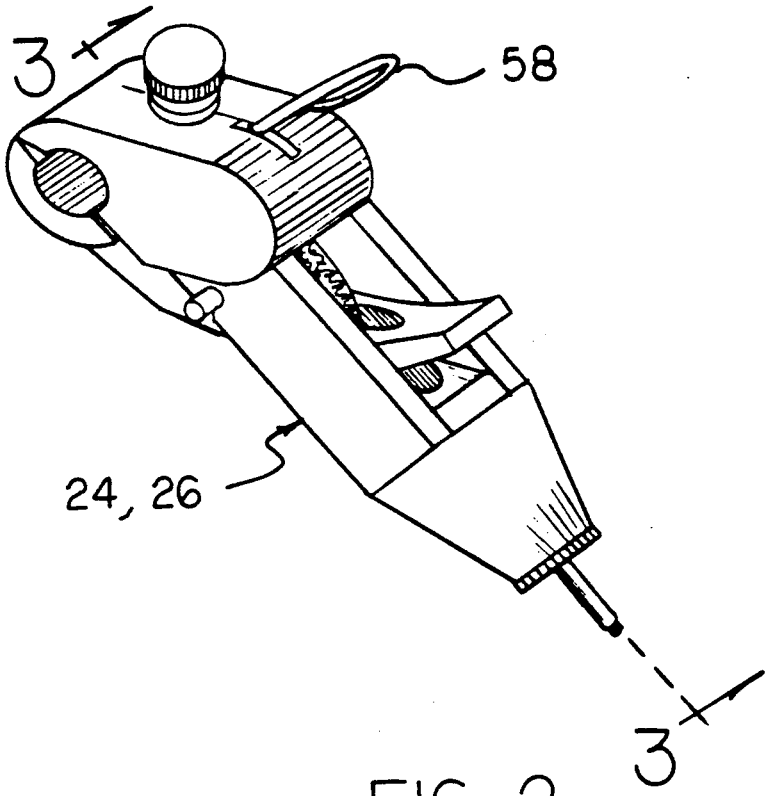
FIG. 2 is a perspective view of a cable clamp forming a part of the present invention.
Figure 3:
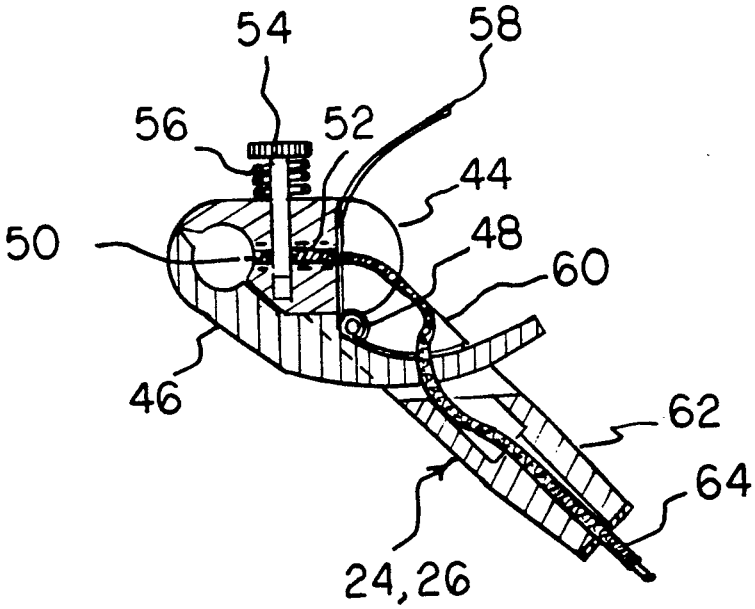
FIG. 3 is a cross-sectional view of the cable clamp as viewed along the line 3—3 in FIG. 2.
Figure 4:
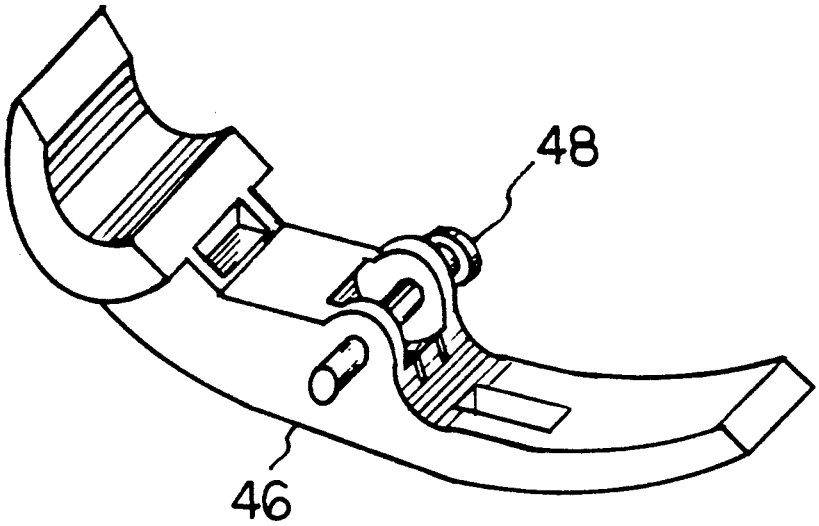
FIG. 4 is a perspective view of the lower jaw portion of the cable clamp.
Figure 5:
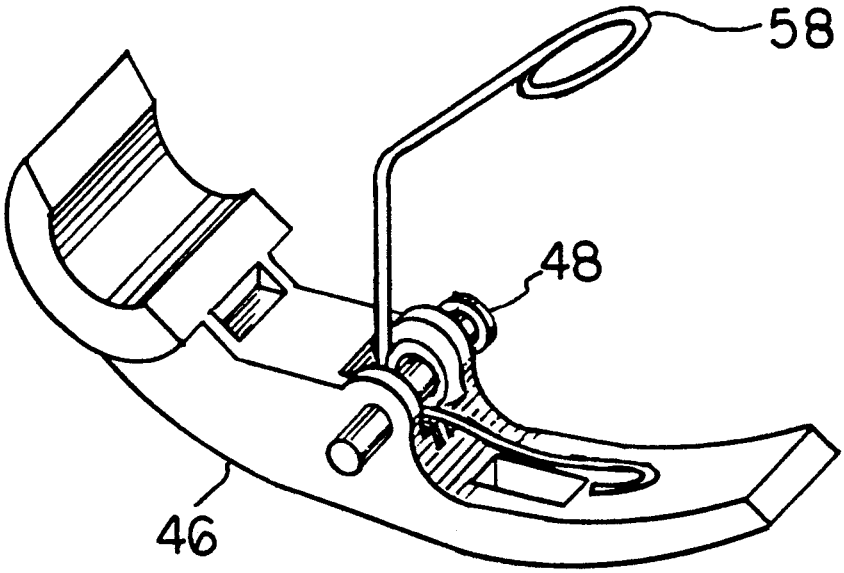
FIG. 5 is a perspective view of the lower jaw portion showing the main spring attached thereto.
Figure 6:
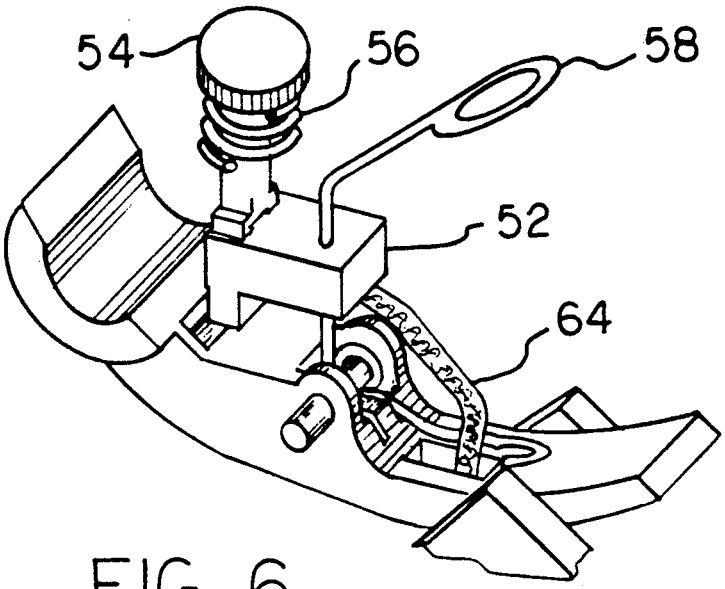
FIG. 6 is a perspective view of the lower jaw portion showing the contact wire and restraining slide attached thereto.
Figure 7:
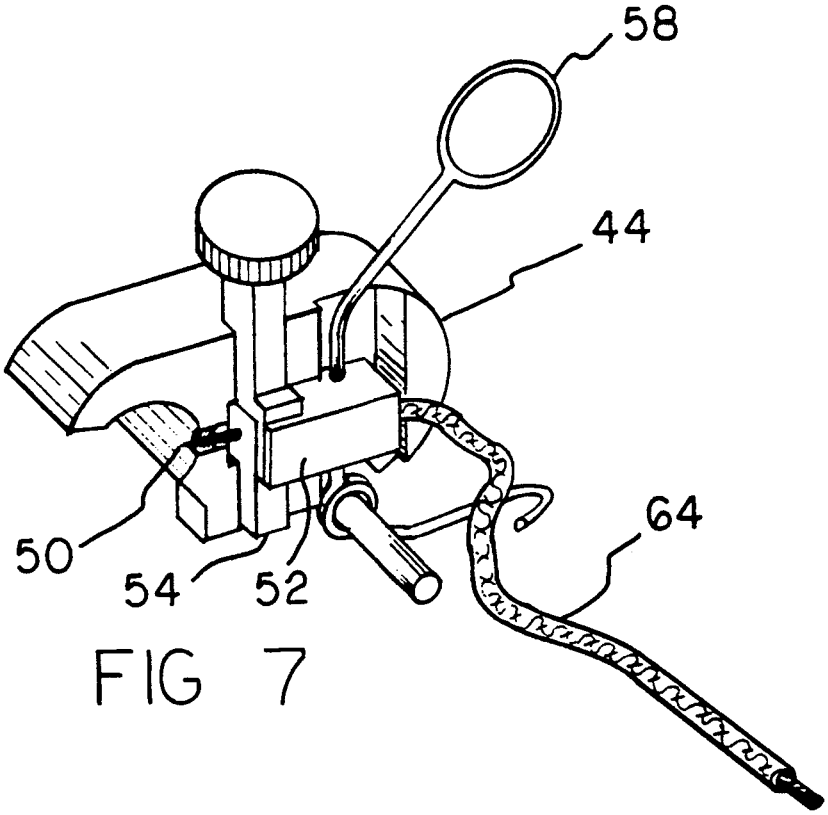
FIG. 7 is a perspective view of the main body of the cable clamp.
Figure 8:
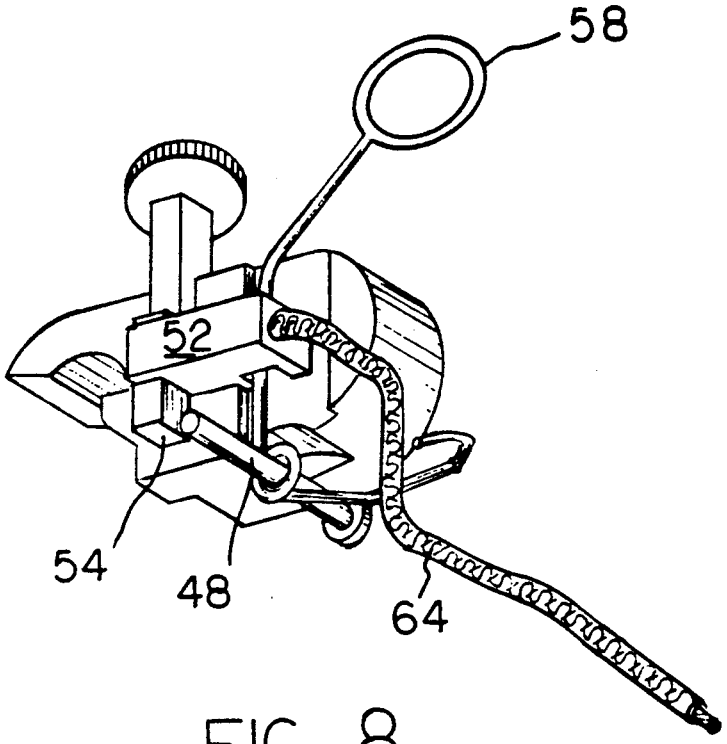
FIG. 8 is a bottom perspective view of the main body.

With reference now to the drawings, and in particular to FIG. 1 thereof, a new and improved D.C. powered lighting system embodying the principles and concepts of the present invention and generally designated by the reference numeral 10 will be described.

More specifically, it will be noted that the lighting system 10 essentially consists of an invertor 12 which converts alternating current to direct current, with direct current being supplied to two strung cables 14, 16 as illustrated. One of the cables 14, 16 is positive and the other cable is negative whereby a completed electrical circuit is established when contact is made between the two power supply cables. One or more halogen lamps 18 are strung from the power cables 14, 16 by means of a pair of rods 20, 22 having respective cable clamps 24, 26 attached to ends thereof. Appropriate contact wires in the cable clamps 24, 26 establish electric contact with the wires 14, 16 and direct such power down through electrical conductors retained within the hollow tubes 20, 22. All of this structure will be subsequently described in greater detail.

With continuing reference to FIG. 1 of the drawings, the insulated cables 14, 16 used in this invention comprise standard 5 millimeter insulated cable available almost anywhere in the United States. It is most often seen as three millimeter braided galvanized steel coated cable coated with one millimeter of clear plastic. The load strength of the cable is 340 pounds.

Remote ends 28, 30 of the respective cables 14, 16 are completely insulated and looped permanently. These ends 28, 30 represent the far ends of the cable and are at a maximum distance from the invertor 12. A pair of eye bolts 32, 34 are attached to a far wall 36, and the cable loops 28, 30 are attached respectively to these eye bolts by small turn buckles to allow adjustment of the tension. The complete length of each cable 14, 16 needs to be enough to reach from the far end wall 36 to the near end wall 38 and down to the invertor 12.

Each cable 14, 16 is attached to the near end wall 38 in much the same manner of the far end wall 36. Eye bolts 40, 42 are attached to the wall 38, and these eye bolts include small turn buckles for tension adjustment; however, the shape of the loops in the cable depend upon the placement of the invertor 12. If the invertor is directly beneath the near ends of the cables 14, 16, each cable could be twisted to form a loop and a small clamp could be used to hold the cables on the turn buckles. If the power source 12 is behind the near wall 38, loops would again be formed in the cables 14, 16 and a clamp would anchor the loops with the cables then extending inwardly through apertures in the wall and down to the invertor.

In FIG. 1, it can be seen that the two cables 14, 16 are strung in this described manner and are paralleledly aligned to each other. The cables 14, 16 can however be made to go in a variety of directions using other eye bolts screwed into ceilings or walls. They can run virtually anywhere as long as they run parallel.

Once the contact portion of the cables 14, 16 has been strung, the near ends thereof are attached to the invertor 12, and the cables remain insulated until they enter the invertor box. There they are solidly attached to their respective poles.

Different effects can be achieved by using differently colored insulation on the cables, either clear or opaque. Clear plastic is the basic color scheme but solid black, opaque, red, blue or any other color combination that comes to mind will change the overall effect. As such, the halo cable system can be matched to any interior.

A power supply which provides the power to operate the halo cable system is supplied by a precision regulated D.C. powered supply. Known as a rectifier, it converts the standard 120 volt, 60 cycle alternating current into 12 volt direct current power at an ampere level in accordance with the rectifier's abilities. The higher the ampere output of the rectifier, the greater the number of lights can be run from it. With an ampere rating of 4.5, the rectifier will be able to light two 20 watt bulbs or one 50 watt bulb. In order to light five 20 watt bulbs on one system, the rectifier will have to have an output of at least 8.4 amperes. If the system has too many lights, the rectifier will exceed its ampere rating and shut down until the excess energy drain is removed.

Figure 9:
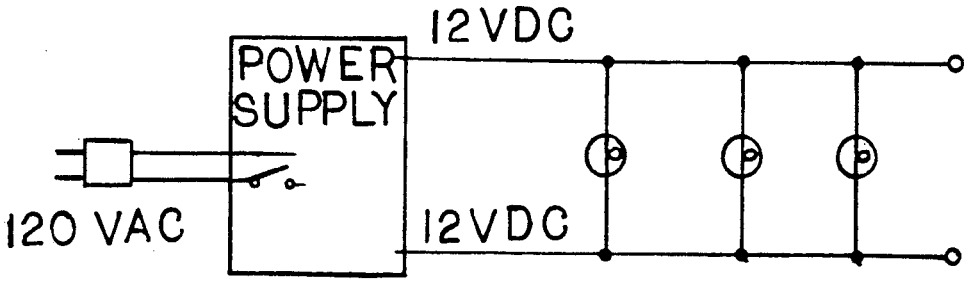
FIG. 9 is an electrical diagram of the electric circuit used in the present invention.

The rectifier 12 can be installed in view or hidden behind a wall as long as it not far from the insulated cables 14, 16. Most commercial units have a switch on the body of the rectifier allowing the user to turn the power flow on and off; however, direct wiring to a light switch is much more convenient. The insulated cables 14, 16 enter the rectifier casing 12 where they are stripped and attached to their respective poles making contact with the power. A locking device or childproof latch keeps the rectifier case closed from prying hands even though chances of electric shock are minimal. The basic electric circuit as above-discussed is shown in FIG. 9.

Figure 10:
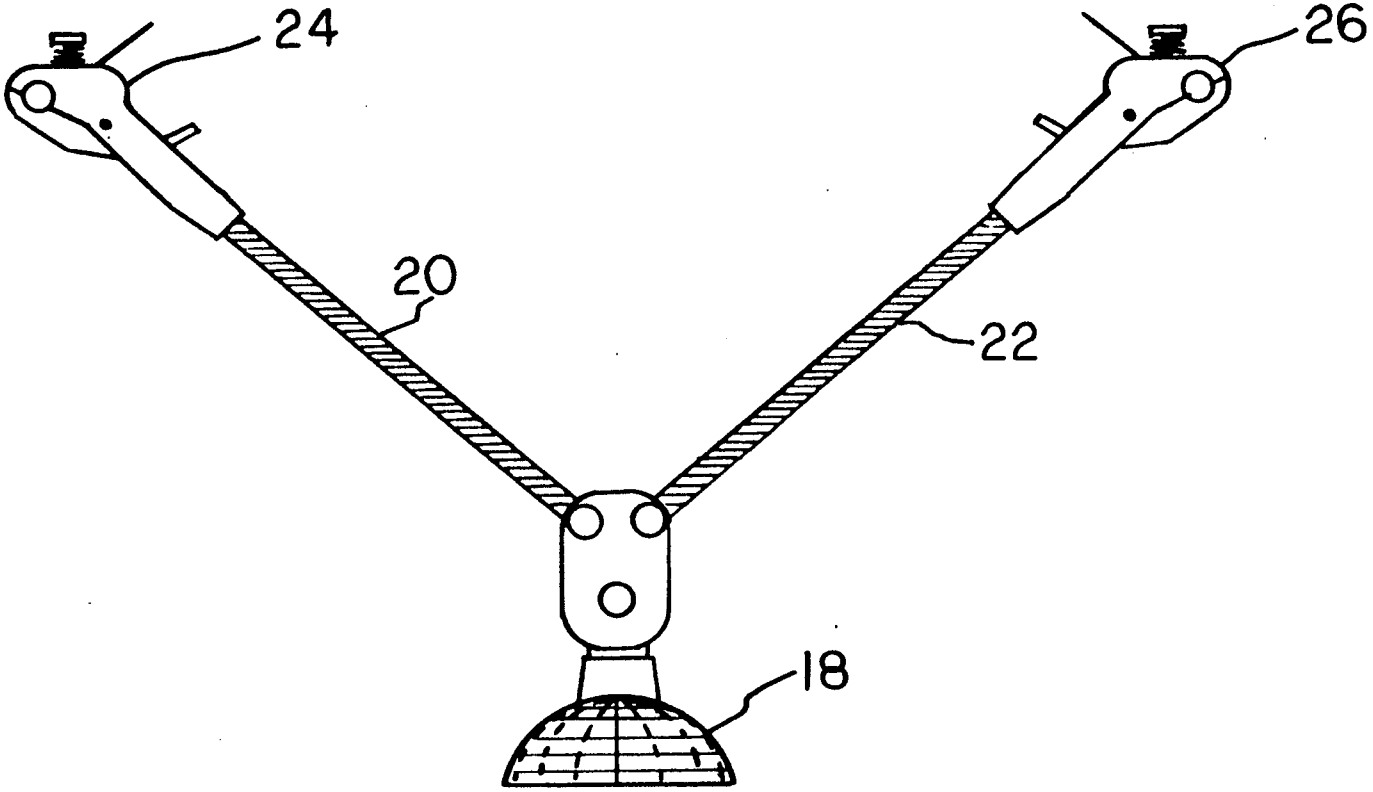
FIG. 10 is a front elevation view illustrating the completed assembly which forms the present invention.

The primary purpose of the lamp fixture 18, as illustrated in FIG. 1 and also in FIG. 10, is to act as a support to which a halogen lamp is attached and receives power. The fixture 18 is suspended from the insulated cable by two sets of cable clamps 24, 26 as aforementioned in combination with the respective hollow rods 20, 22.

The fixture 18 holds the light in place beneath it with metallic clamps embedded in an insulated plastic. These clamps also send the power directly to the post of the lamp. The plastic in which the clamps are embedded hinges with the larger plastic sides of the main body so as to allow the lamp to be angled up to 90 degrees to either side. Power is brought to the light through insulated wires carried down the hollow rods 20, 22 which are connected to the main body 18. These hollow rods 20, 22 are fastened to the main body at hinge points allowing further angling of the light.

As above-explained, the two hollow rods 20, 22 needed for each light carry the insulated wire from the respective cable clamps 24, 26 down to the lamp fixture 18. One rod 20 carries the positive wire while the other carries the negative wire. Once the wire is strung through, the rods 20, 22 are permanently attached to the cable clamps 24, 26 and the lamp fixture 18. The rods 20, 22 need to be heavy enough to support the lamp fixture 18 suspended below, yet not so heavy whereby the insulated cables 14, 16 will be bowed down by excess weight. A good example would be antenna rod used on radio receivers.

The length of the rods is determined before assembly. They can be of almost any length from two inches to two feet depending upon the desires of the user. The longer the rods 20, 22, the lower the light will drop below or rise above the insulated cables 14, 16. The distance the cables 14, 16 are apart also determines the final amount of rise or fall of the light fixture 18. FIG. 10 of the drawings illustrates the integration of the hallow rods 20, 22 into the system 10.

With reference to FIGS. 2–8 of the drawings, a complete description of one of the cable clamps 24, 26 will be provided. The purpose of each cable clamp 24, 26 is to pierce the insulation on the cables 14, 16 and make contact with the power flowing through them. The power is taken from the cables 14, 16 and sent down the afore-described insulated wire to the halogen lamp.

Cable clamps 24, 26 are identical in structure and include a main body 44, a lower jaw 46 attached to the main body by a hinge pin 48, a cable contact pin 50, and a contact pin slide 52. Additionally, each clamp includes a restraining slide 54, a restraining slide spring 56, a main spring 58, a body support 60, a rod connection 62, and an insulated wire 64 directed down to the halogen light.

Using tension from the main spring 58 rising through its middle, the cable clamp 24, 26 pinches the insulated cable 14, 16 between its jaws. This same spring tension allows the contact pin 50 to pierce the insulated casing on each cable 14, 16 and make contact with the power beneath. A pin 50 is held back from piercing a cable casing until it is released by the restraining slide 54. The power from the cable 14, 16 is transferred through the contact pin 50 down the wire 64 which emerges from the bottom of the cable clamp 24, 26, and threads through one of the hollow rods 20, 22 to the fixture 18 below.

The contact pin slide 52 holds the contact pin 5 and the contact wire 64. The slide moves within the main body 60 lengthwise allowing the pin to pierce the cable coating and making contact with power. The movement is provided by the afore-described main spring 58 being contracted and released. This movement allows the pin 50 to be extracted and inserted into the cable casing whenever necessary.

The restraining slide 54 moves vertically (orthogonally to the contact pin slide 52), and its purpose is to keep the contact pin 50 from penetrating the cable casing until released. When the main spring 58 is contracted, the restraining slide 54 moves up, blocking the movement of the contact pin slide 52. The upward movement is provided by the restraining slide spring 56. When depressed, the restraining slide 54 moves downward allowing the contact pin slide 52 to pass through its middle without hinderance.

The main body 60 contains many hollow spaces to facilitate the movement of the various interior components. It keeps the components together as one type package, and construction is simplified by creating two almost identical halves and affixing them together once the slides 52, 54 and spring 58 are inserted.

The lower jaw 46 is attached to the main body 60 by the hinge pin 48. Its purpose is to clamp the insulated cable 14, 16 between itself and the main body 60 by leveraging the tension from the main spring 58. The lower jaw 46 fits neatly to the bottom of the main body 60.

As illustrated, the main spring 58 is one piece of heavy gauge spring wire, with the upper portion shaped in a circle to provide a pad to be compressed by a user's fingers. The lower section lies flush with the lower jaw 46 and is compressed along with the upper section. The main vertical shaft rises through the contact pin slide and when the spring 58 is compressed, the slide 52 moves to the rear of the main body 60 and then to the front of the main body upon release.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved direct current lighting system an inverter for converting alternating current to direct current so as to provide a supply of direct current electricity to said system;

a pair of direct current power supply cables in electrical communication with said inverter, said pair of direct power supply cables being paralleledly aligned and strung in a convenient location;

at least one lamp fixture operable by direct current electricity, said at least one lamp fixture being supported by said pair of direct current power supply cables and receiving direct current electric power therefrom;

cable clamping means for facilitating an attachment of said at least one lamp fixture to said pair of direct current power supply cables, said cable clamping means comprising first and second cable clamps, said first cable clamp being attachable to a first of said pair of direct current power supply cables and said second cable clamp being attachable to a second one of said pair of direct current power supply cables, said first and second cable clamps being provided with first and second piercing pins respectively, said first and second piercing pins being operable to pierce an insulated casing over said first and second direct current power supply cables, thereby to establish electrical communication between said first and second pins and said first and second direct current power supply cables respectively;

and insulated power supply wires connected to said first and second piercing pins, said insulated power supply wires being in electrical communication with said at least one lamp fixture.

2. The new and improved direct current lighting system as described in claim 1, wherein said first and second cable clamps are provided with jaws to facilitate an attachment thereof to said first and second of said direct current power supply cables.

3. The new and improved direct current lighting system as described in claim 2, wherein manually operated main spring devices are utilized to force said first and second piercing pins through said insulated casing surrounding said pair of direct current power supply cables.

* * * * *